US006558200B1

(12) United States Patent
Choy

(10) Patent No.: US 6,558,200 B1
(45) Date of Patent: May 6, 2003

(54) CARD EDGE CONNECTOR WITH COMMONING CONTACTS AND INDIVIDUAL CONTACTS AND METHOD MAKING THE SAME

(75) Inventor: Edmond Choy, Union City, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/041,868

(22) Filed: Jan. 7, 2002

(51) Int. Cl.[7] ..... H01R 24/00
(52) U.S. Cl. ..... 439/637; 439/108; 439/567
(58) Field of Search ..... 439/637, 60, 80–82, 439/59, 108, 567, 101, 636

(56) References Cited

U.S. PATENT DOCUMENTS 5,161,987 A * 11/1992 Sinisi ..... 439/108
5,411,404 A * 5/1995 Korsunsky et al. ..... 439/567
5,634,819 A * 6/1997 Pan et al. ..... 439/637
5,876,214 A * 3/1999 McHugh et al. ..... 439/637
6,089,883 A * 7/2000 McHugh et al. ..... 439/108
6,254,405 B1 * 7/2001 Hung ..... 439/101
6,331,122 B1 * 12/2001 Wu ..... 439/567

* cited by examiner

*Primary Examiner*—P. Austin Bradley
*Assistant Examiner*—Felix O. Figueroa
(74) *Attorney, Agent, or Firm*—Wei Te Chung

(57) ABSTRACT

A card edge connector includes an insulative housing defining a central slot along a longitudinal direction thereof. Two rows of passageways are disposed by two sides of the central slot, respectively. An elongated slit is formed in an outer side of each corresponding row of the passageways. A contact strip includes a elongated strip retention portion retained in the corresponding slit, a plurality of first contacts extending, from an upper portion of the retention portion, laterally into the some corresponding designated passageways. A plurality of discrete second contacts are respectively retainably disposed in the remaining passageways.

1 Claim, 7 Drawing Sheets

CARD EDGE CONNECTOR WITH COMMONING CONTACTS AND INDIVIDUAL CONTACTS AND METHOD MAKING THE SAME

BACKGROUND OF THE INVENTION

1. Field of the Invention

The invention relates to card edge connectors, and particularly to the card edge connector with individual signal contacts and commoning power contacts and the method making the same.

2. The Related Arts

Card edge connectors are popularly used in the computer industry, for example, Micro Channel connectors, EISA connectors and DIMM connectors, etc. The contacts used in the card edge connectors generally include two types of which one is the so-called forming type in which the curved contact portion is successively bent/formed after the individual contact has been stamped from the metal sheet, and the other is the so-called blanking type in which the curved contact portion generally is directly formed when the individual contact is being stamped from the metal sheet.

The advantage of the former is to own the superior resiliency and the contacts on the same side of the connector housing can be commonly formed on the same carrier and simultaneously inserted into the corresponding passageways. For example, U.S. Pat. No. 4,996,766 discloses a card edge connector, i.e., the EISA connector, with two level contacts which are of the so-called forming contacts arranged on the same contact carrier and adapted to be inserted into the corresponding passageways of the housing at one time.

Oppositely, the advantage of the latter is to own the more precise shape of the contacts than the forming type, and have only one step, i.e., direct stamping, to form each individual contact rather than two steps, i.e., one stamping plus one forming, required by the forming type one. For example, U.S. Pat. No. 6,162,102 discloses the so-called blanking type in which the odd configuration of the curved contact portion or even the dual-beam contact portion can be achieved.

From another viewpoint, in some applications some of the individual contacts in the connector are expected to be electrically connected. Under such a condition, the jumper strip(s) or the shunting bar(s) is/are intentionally applied to the connector for implementation of commoning such specific contacts, for example, U.S. Pat. No. 4,487,464 (the card edge connector) and U.S. Pat. No. 6,024,597 (the cable connector).

The invention is to provide a card edge connector with some commoned designated contacts in an easy manufacturing way.

SUMMARY OF THE INVENTION

According to an aspect of the invention, a card edge connector includes an insulative housing defining a central slot along a longitudinal direction thereof. Two rows of passageways are disposed by two sides of the central slot, respectively. An elongated slit is formed in an outer side of each corresponding row of the passageways. The slit is configured to laterally communicate with some designated passageways in the corresponding row. A contact strip includes a elongated strip retention portion retained in the corresponding slit, a plurality of first contacts extending, from an upper portion of the retention portion, laterally into the some corresponding designated passageways and communicating with the central slot, and a plurality of tail portions extending downwardly from a lower portion of the retention portion out of a bottom face of the housing. A plurality of discrete second contacts are respectively retainably disposed in the remaining passageways with the corresponding tail portions extending downwardly out of the bottom face of the housing.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
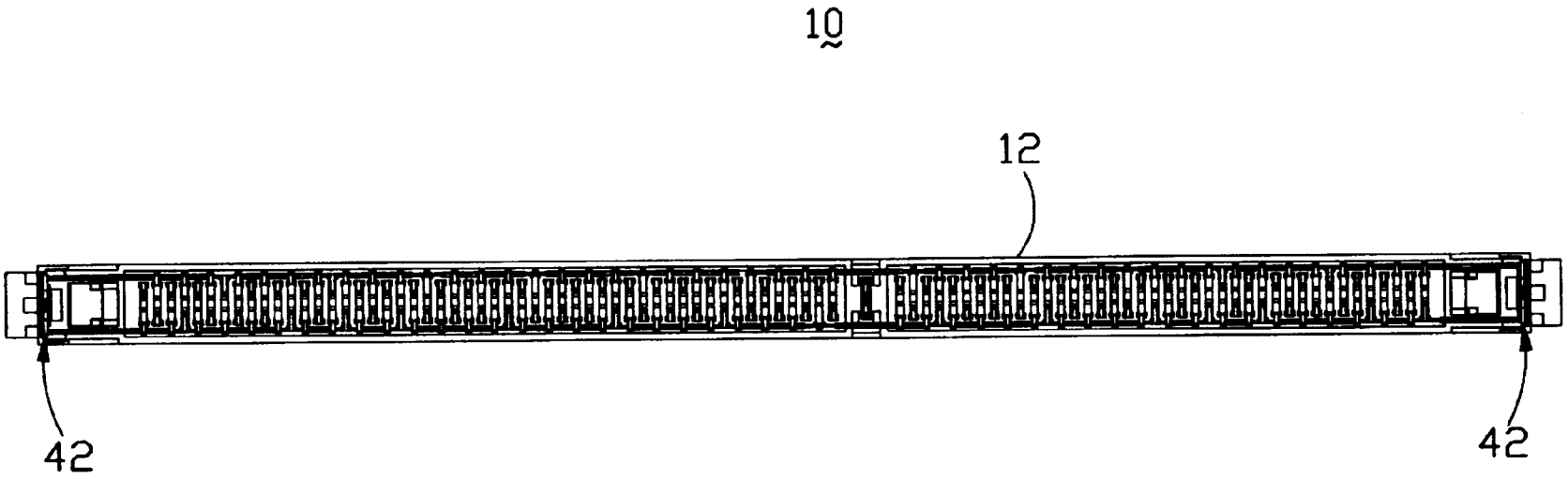
FIG. 1 is a bottom view of the DIMM connector according to the invention.
Figure 2:
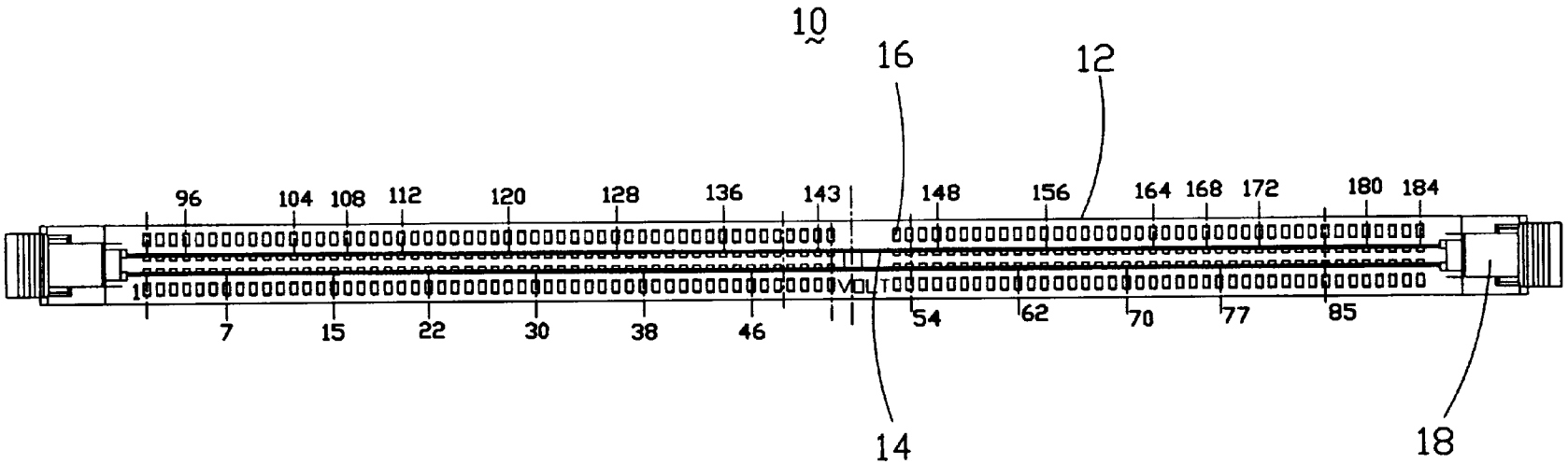
FIG. 2 is a top view of the DIMM connector of FIG. 1 where some positions have been numbered to show the contacts in the corresponding passageways are commoned via the contact strip.
Figure 3:
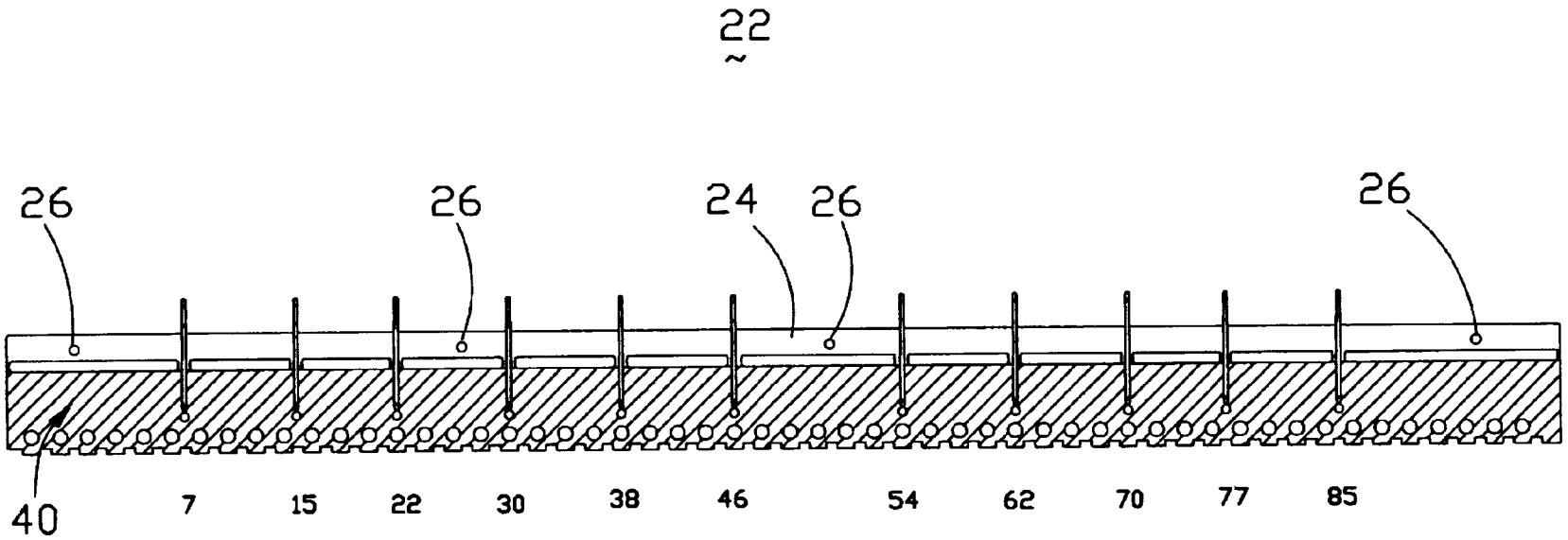
FIG. 3 is a plan view of one of the two contact strips, with the unmoved carrier thereon, used in the DIMM connector of FIG. 1.
Figure 4A:
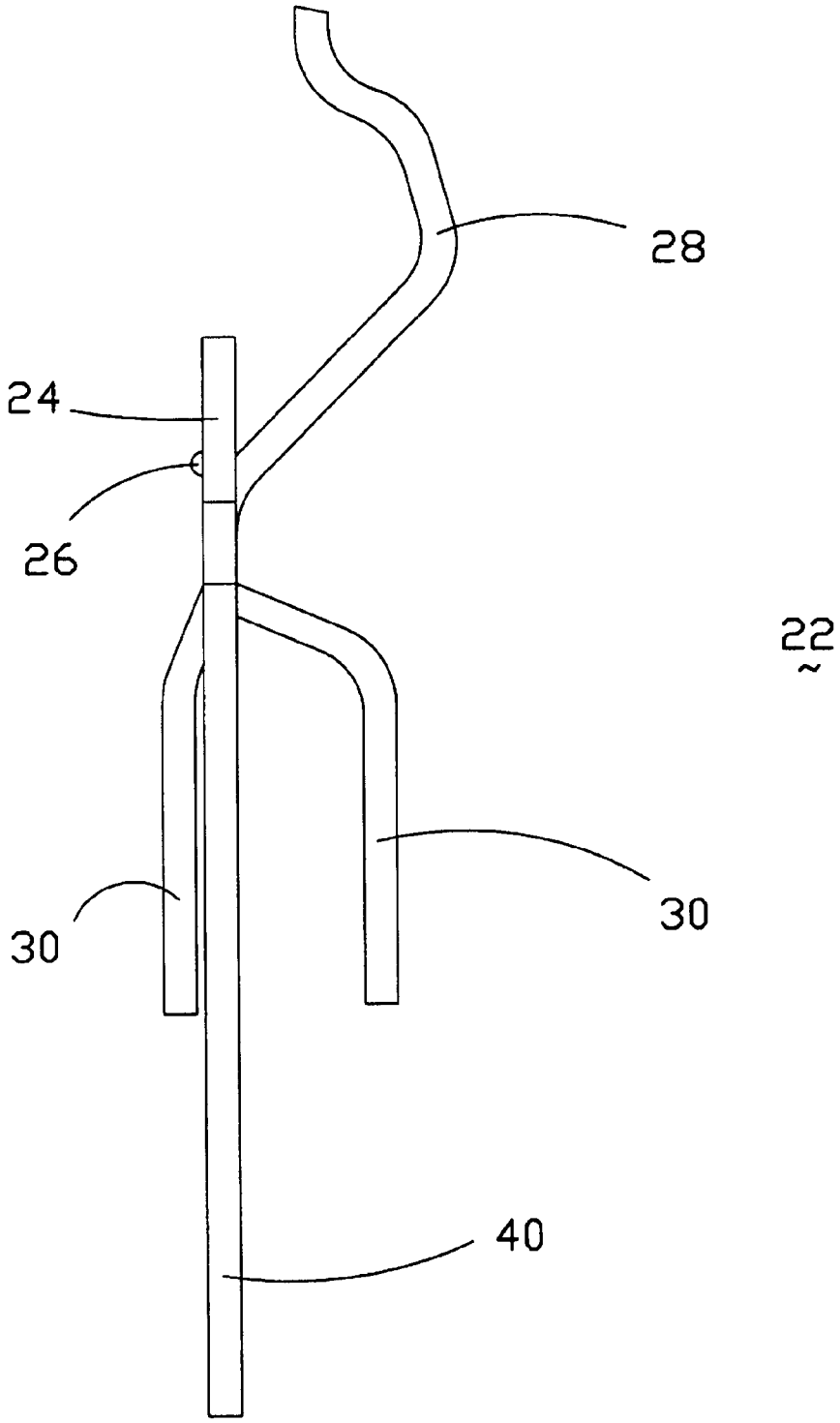
FIG. 4(A) is a side view of the contact strip with the carrier thereon of FIG. 3.
Figure 4B:
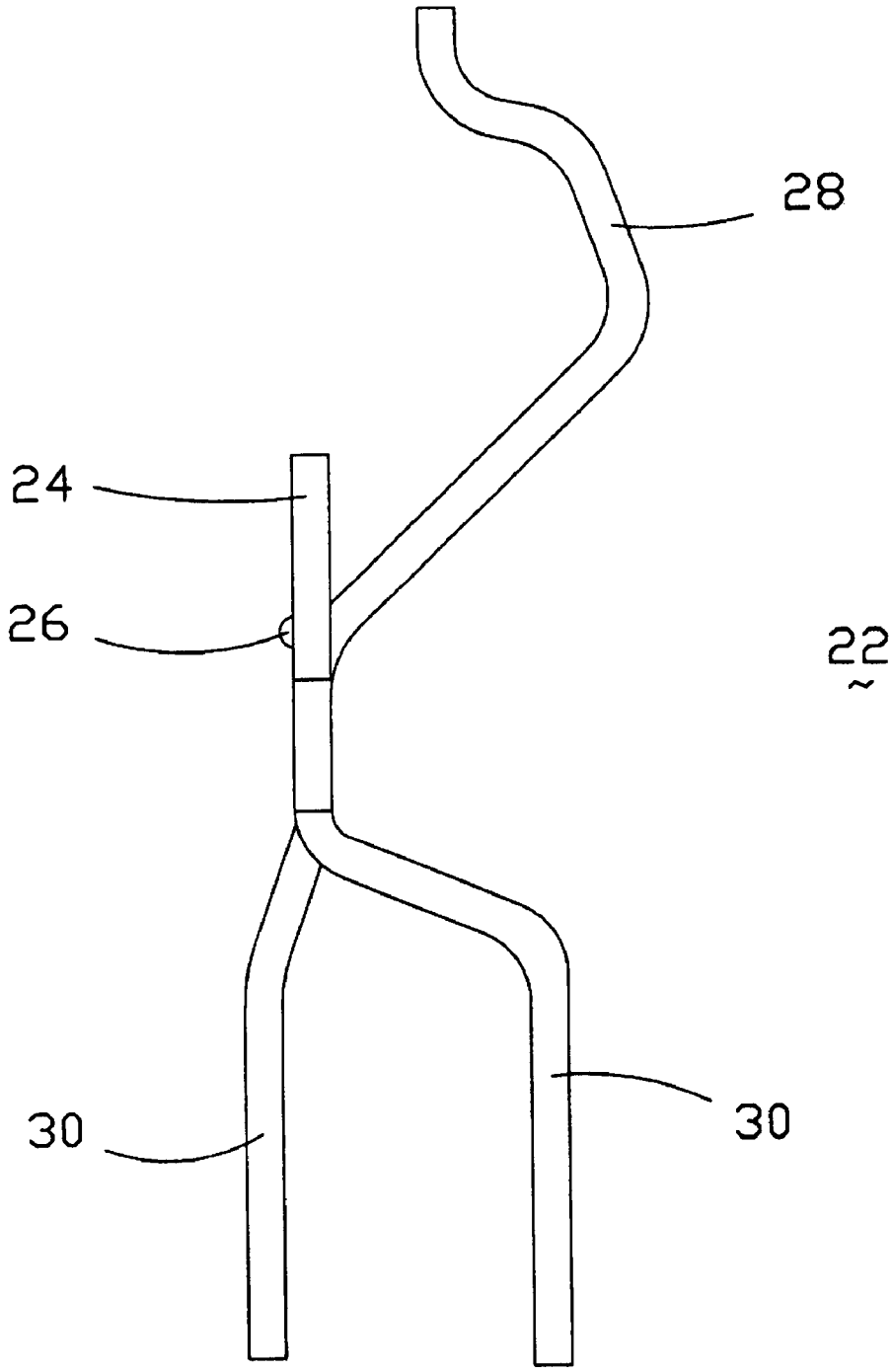
FIG. 4(B) is a side view of the contact strip without the carrier thereon of FIG. 4(A).
Figure 5:
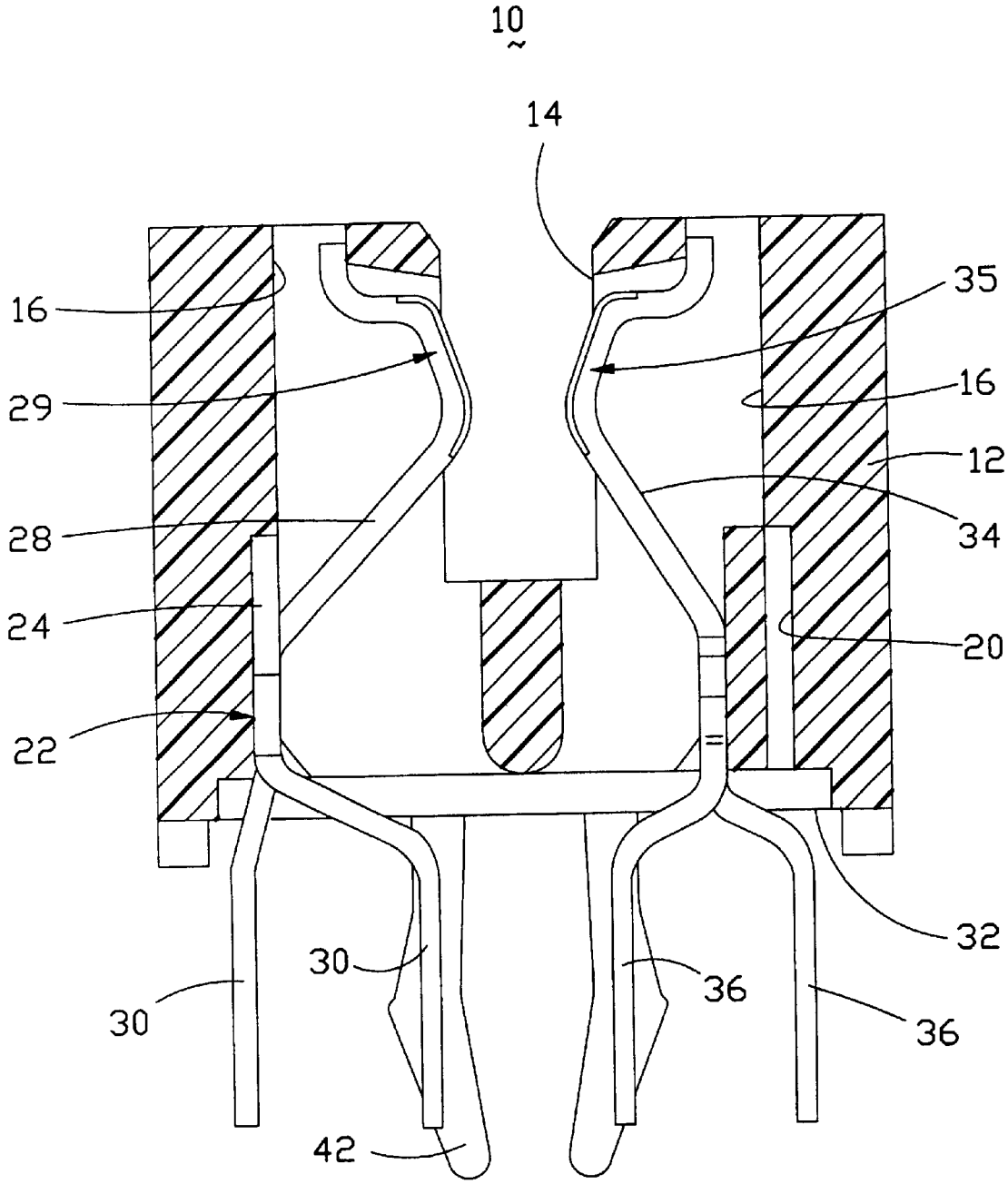
FIG. 5 is a cross-sectional view of the DIMM connector of FIG. 1, showing the first contact extending from the contact strip, and the discrete second contact in which, for clearly showing the differences between the first contacts and the second contacts, second contacts including the second tails on the left side are not shown, the first contacts including the first tails and the associated contact strip on the right side are not shown, and the ejector and the end portion of the housing are not shown.
Figure 6:
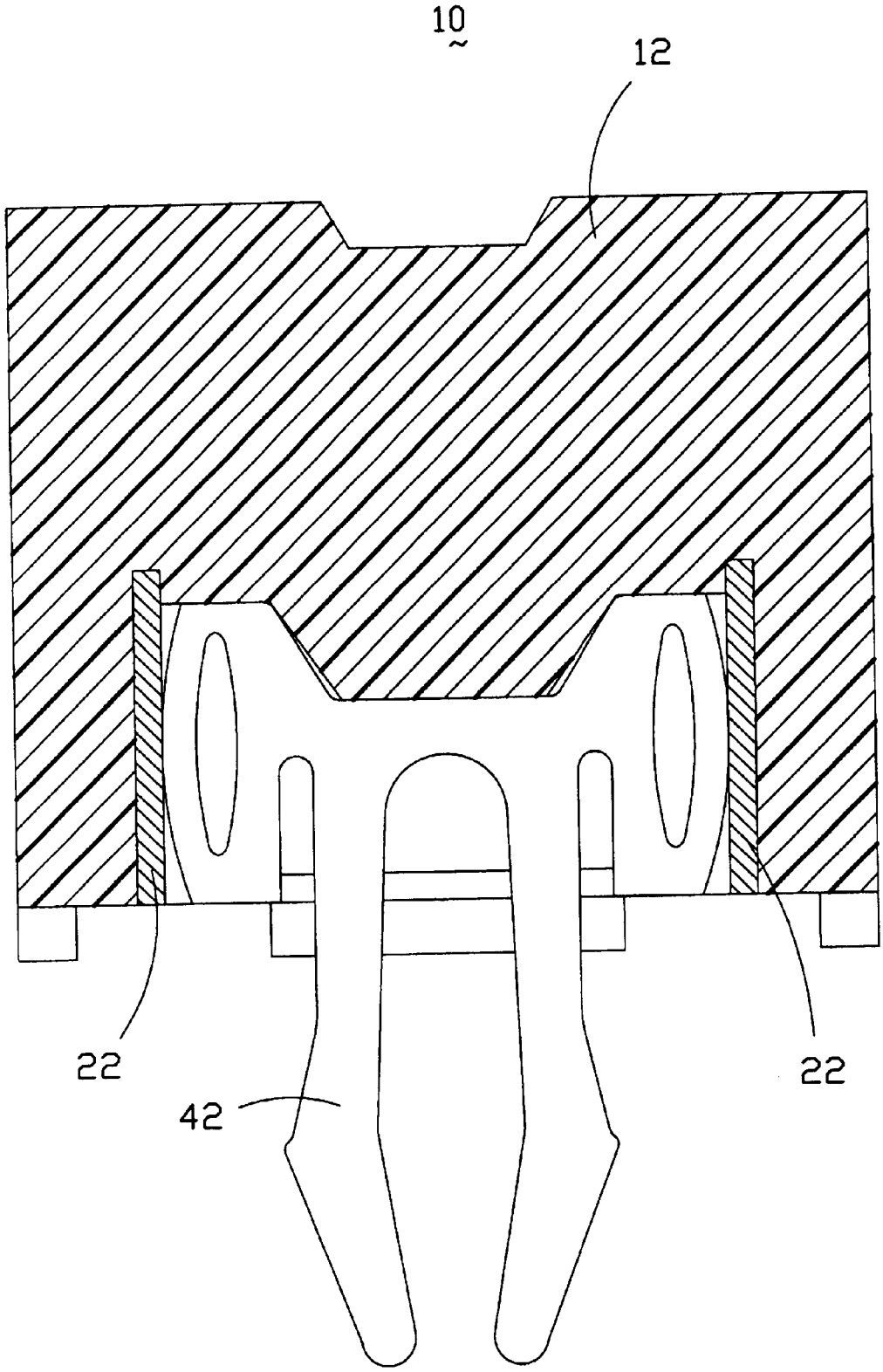
FIG. 6 is a cross-sectional view of the housing without showing the ejectors thereof, to illustrate engagement between the metal hold-down and the contact strip.

It will be noted here that for a better understanding, most of like components are designated by like reference numerals throughout the various figures in the embodiments. Attention is directed to FIGS. 1–6, wherein a DIMM connector 10 includes an insulative housing 12 with a central slot 14 extending along a longitudinal direction thereof. Two rows of passageways 16 are formed by two sides of the central slot 14. A pair of ejectors 18 are disposed at two opposite longitudinal ends of the housing 12 for ejection of the inserted card (not shown) out of the central slot 14.

An elongated slit 20 is formed on an outer side of each row of the passageways 16. The slit 20 are arranged to laterally communicate with some designated passageways 16. A contact strip 22 includes an elongated intermediate or retention portion 24 retainably received in each corresponding elongated slit 20. In this embodiment, the embossments 26 on the contact strip 22 interfere within the elongated slit

20 to retain the contact strip 22 in position. A plurality of first contacts 28 extend from an upper portion of the retention portion 24 and into the aforementioned those designated passageways 16, respectively. A plurality of first tails 30 extend from a lower portion of the retention portion 24, generally in alignment with the first contacts 28, and out of the bottom face 32 of the housing 12.

Oppositely, a plurality of discrete second contacts 34 are respectively and individually retained and disposed in the corresponding remaining passageways 16. Understandably, in this embodiment both the first contacts 28 and the second contacts 34 extend into the central slot 14 for mechanical/electrical engagement with the inserted card (not shown). Each second contact 34 further includes a second tail 36 extending out of the bottom face 30 of the housing 12.

It can be contemplated that the feature of the invention is to provide an elongated slit 20, along a longitudinal direction of the housing 12, beside the passageways 16 and communicating with some designated passageways 16, and provide the contact strip 22 with the elongated retention portion 24 retainably received within the slit 20 and with the corresponding first contacts 28 extending into those designated passageways 16. Understandably, the second contacts 34 are still respectively retainably received within the corresponding passageways 16 via the traditional assembling method where those second contacts 34 are first stamped and formed on a contact strip (not shown) linked by a carrier (not shown) and later disconnected from that carrier (not shown) after assembled into the corresponding passageways 16. It is also noted that the contact strip 22 used in the invention, is also originally connected via a carrier 40 for easy assembling to the housing while such a carrier 40 is removed once the contact strip 22 has been assembled to the housing 12. It can been seen that the retention of the contact strip 22 with regard to the housing 12 can be formed on each first contact 28 instead of the elongated retention portion 24, alternately.

It is also noted that the contact portions 29 of the first contacts 28 and the contact portions 35 of the second contacts 34 still keep the same contour with each other as the traditional DIMM connector, and that all the tails regardless of the first tails 30 and the second tails 36, are still arranged in a staggered manner for compliance with the layout of the printed circuit board on which the DIMM connector 10 is mounted. In other words, the first tails 30 may be either in an inner position or in an outer position, depending upon the odd numbers or the even numbers of the positions the first contacts is disposed at along the longitudinal direction of the housing 12, and similarly the second tails 36 follow the same rule.

In application, a pair of metal hold-downs 42 are respectively located under the corresponding ejectors 18. Each of the metal hold-down 42 mechanically and electrically engages the corresponding distal end of the retention portion 24 for establishing a conductive connection thereof.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included in the scope of the following claims.

I claim:

1. A card edge connector comprising:

an insulative housing defining a central slot along a longitudinal direction thereof;

two rows of passageways formed by two sides of said central slot;

a slit formed by at least one of said rows of passageways;

a contact strip including an elongated retention portion retainably received within said slit, and a plurality of first contacts extending from said retention portion and into some designated passageways; and a plurality of second contacts respectively and independently retainably received within the remaining passageways wherein said slit is positioned in an outer side of said at least one of said rows of passageways;

wherein a pair of metal hold-downs are located at two opposite longitudinal ends of the housing, and said contact strip mechanically end electrically engages at least one of said pair of metal hold-downs;

wherein said slit laterally communicates with said some designated passageways;

wherein said first contact upwardly extend from said retention portion; and wherein said contact strip includes tail portion extending from said retention portion and arranged in two rows.

* * * * *